US006520834B1

(12) United States Patent
Marshall

(10) Patent No.: US 6,520,834 B1
(45) Date of Patent: Feb. 18, 2003

(54) METHODS AND APPARATUSES FOR ANALYZING AND CONTROLLING PERFORMANCE PARAMETERS IN MECHANICAL AND CHEMICAL-MECHANICAL PLANARIZATION OF MICROELECTRONIC SUBSTRATES

(75) Inventor: Brian Marshall, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 157 days.

(21) Appl. No.: 09/634,057

(22) Filed: Aug. 9, 2000

(51) Int. Cl.[7] ..... B24B 49/00; B24B 51/00

(52) U.S. Cl. ..... 451/5; 451/10; 451/9; 451/41; 451/59; 451/288; 451/550

(58) Field of Search ..... 451/5, 8, 9, 10, 451/11, 41, 63, 59, 285–290, 533, 550; 216/88, 89; 438/692, 693

(56) References Cited

U.S. PATENT DOCUMENTS

| | | | |
|---|---|---|---|
| 5,020,283 | A | 6/1991 | Tuttle |
| 5,196,353 | A | 3/1993 | Sandhu et al. |
| 5,222,329 | A | 6/1993 | Yu |
| 5,232,875 | A | 8/1993 | Tuttle et al. |
| 5,240,552 | A | 8/1993 | Yu et al. |
| 5,244,534 | A | 9/1993 | Yu et al. |
| 5,314,843 | A | 5/1994 | Yu et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,540,810 | A | 7/1996 | Sandhu et al. |
| 5,609,718 | A | 3/1997 | Meikle |
| 5,616,069 | A | 4/1997 | Walker et al. |
| 5,618,381 | A | 4/1997 | Doan et al. |
| 5,624,303 | A | 4/1997 | Robinson |
| 5,643,048 | A | 7/1997 | Iyer |

(List continued on next page.)

OTHER PUBLICATIONS

U.S. patent application Ser. No. 09/289,791, Meikle et al., filed Apr. 9, 1999.

(List continued on next page.)

*Primary Examiner*—Timothy V. Eley
(74) *Attorney, Agent, or Firm*—Perkins Cole LLP

(57) ABSTRACT

Methods and apparatuses for analyzing and controlling performance parameters in planarization of microelectronic substrates. In one embodiment, a planarizing machine for mechanical or chemical-mechanical planarization includes a table, a planarizing pad on the table, a carrier assembly, and an array of force sensors embedded in at least one of the planarizing pad, a sub-pad under the planarizing pad, or the table. The force sensor array can include shear and/or normal force sensors, and can be configured in a grid pattern, concentric pattern, radial pattern, or a combination thereof. Analyzing and controlling performance parameters in mechanical and chemical-mechanical planarization of microelectronic substrates includes removing material from the microelectronic substrate by pressing the substrate against a planarizing surface, determining a force distribution exerted against the substrate by sensing a plurality of forces at a plurality of discrete nodes as the substrate rubs against the planarizing surface, and controlling a planarizing parameter of a planarizing cycle according to the determined force distribution. A planarizing pad or sub-pad for mechanical or chemical-mechanical planarization in accordance with an embodiment of the invention can include a body having a plurality of raised portions and a plurality of low regions between the raised portions, and a plurality of force sensors embedded in the body at locations relative to the raised portions. Positioning the sensors relative to the raised portion can isolate shear and/or normal forces exerted against the pad by the microelectronic substrate during planarization.

35 Claims, 9 Drawing Sheets

U.S. PATENT DOCUMENTS 5,645,682 A 7/1997 Skrovan
5,650,619 A 7/1997 Hudson
5,655,951 A 8/1997 Meikle et al.
5,658,190 A 8/1997 Wright et al.
5,663,797 A 9/1997 Sandhu
5,679,065 A 10/1997 Henderson
5,690,540 A 11/1997 Elliott et al.
5,698,455 A 12/1997 Meikle et al.
5,702,292 A 12/1997 Brunelli et al.
5,725,417 A 3/1998 Robinson
5,736,427 A 4/1998 Henderson
5,738,567 A 4/1998 Manzonie et al.
5,747,386 A 5/1998 Moore
5,762,536 A * 6/1998 Pant et al. ..... 451/296
5,779,522 A 7/1998 Walker et al.
5,782,675 A 7/1998 Southwick
5,792,709 A 8/1998 Robinson et al.
5,795,218 A 8/1998 Doan et al.
5,795,495 A 8/1998 Meikle
5,798,302 A 8/1998 Hudson et al.
5,801,066 A 9/1998 Meikle
5,823,855 A 10/1998 Robinson
5,830,806 A 11/1998 Hudson et al.
5,846,336 A 12/1998 Skrovan
5,855,804 A 1/1999 Walker
5,868,896 A 2/1999 Robinson et al.
5,871,392 A 2/1999 Meikle et al.
5,879,222 A 3/1999 Robinson
5,879,226 A 3/1999 Robinson
5,882,248 A 3/1999 Wright et al.
5,893,754 A 4/1999 Robinson et al.
5,894,852 A 4/1999 Gonzales et al.
5,910,043 A 6/1999 Manzonie et al.
5,910,846 A 6/1999 Sandhu
5,934,980 A 8/1999 Koos et al.
5,938,801 A 8/1999 Robinson
5,954,912 A 9/1999 Moore
5,972,792 A 10/1999 Hudson
5,976,000 A 11/1999 Hudson
5,980,363 A 11/1999 Meikle et al.
5,981,396 A 11/1999 Robinson et al.
5,989,470 A 11/1999 Doan et al.
5,994,224 A 11/1999 Sandhu et al.
5,997,384 A 12/1999 Blalock
6,036,586 A 3/2000 Ward
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,083,085 A 7/2000 Lankford
6,106,351 A 8/2000 Raina et al.
6,108,092 A 8/2000 Sandhu
6,110,820 A 8/2000 Sandhu et al.
6,114,706 A 9/2000 Meikle et al.
6,120,354 A 9/2000 Koos et al.
6,124,207 A 9/2000 Robinson et al.
6,139,402 A 10/2000 Moore
6,143,123 A 11/2000 Robinson et al.
6,186,870 B1 2/2001 Wright et al.
6,187,681 B1 2/2001 Moore
6,190,494 B1 2/2001 Dow
6,191,037 B1 2/2001 Robinson et al.
6,191,864 B1 2/2001 Sandhu
6,200,901 B1 3/2001 Hudson et al.
6,203,407 B1 3/2001 Robinson
6,203,413 B1 3/2001 Skrovan
6,206,754 B1 3/2001 Moore
6,206,759 B1 3/2001 Agarwal et al.
6,206,769 B1 3/2001 Walker
6,210,257 B1 4/2001 Carlson
6,213,845 B1 4/2001 Elledge
6,227,955 B1 5/2001 Custer et al.
6,234,877 B1 5/2001 Koos et al.
6,234,878 B1 * 5/2001 Moore ..... 451/41
6,238,270 B1 5/2001 Robinson
6,238,273 B1 5/2001 Southwick
6,244,944 B1 6/2001 Elledge
6,250,994 B1 6/2001 Chopra et al.
6,257,953 B1 * 7/2001 Gitis et al. ..... 451/287
6,261,163 B1 7/2001 Walker et al.
6,271,139 B1 8/2001 Alwan et al.
6,273,101 B1 8/2001 Gonzales et al.
6,273,800 B1 8/2001 Walker et al.
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,014 B1 10/2001 Walker et al.
6,309,282 B1 10/2001 Wright et al.
6,312,558 B2 11/2001 Moore
6,319,420 B1 11/2001 Dow
6,322,422 B1 * 11/2001 Satou ..... 451/283
6,323,046 B1 11/2001 Agarwal
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,350,180 B2 2/2002 Southwick
6,350,691 B1 2/2002 Lankford
6,352,466 B1 3/2002 Moore
6,352,470 B2 3/2002 Elledge

OTHER PUBLICATIONS

U.S. patent application Ser. No. 09/387,309, Hofmann et al., filed Aug. 31, 1999.
U.S. patent application Ser. No. 09/386,648, Hofmann et al., filed Aug. 31, 1999.
Tekscan, Industrial Overview, http://www.tekscan.com/industrial.html, Dec. 1, 2000, 2 pages.
Tekscan, Flexiforce Product Group, http://www.tekscan.com/flexiforce.html, Dec. 1, 2000, 1 page.
Tekscan, Tekscan Technology, http://www.tekscan.com/technology.html, Dec. 1, 2000, 6 pages.

* cited by examiner

METHODS AND APPARATUSES FOR ANALYZING AND CONTROLLING PERFORMANCE PARAMETERS IN MECHANICAL AND CHEMICAL-MECHANICAL PLANARIZATION OF MICROELECTRONIC SUBSTRATES

TECHNICAL FIELD

This invention relates to analyzing and controlling performance parameters of a planarizing cycle of a microelectronic substrate in mechanical and/or chemical-mechanical planarization processes.

BACKGROUND

Mechanical and chemical-mechanical planarization processes (collectively "CMP") are used in the manufacturing of electronic devices for forming a flat surface on semiconductor wafers, field emission displays and many other microelectronic device substrate assemblies. CMP processes generally remove material from a substrate assembly to create a highly planar surface at a precise elevation in the layers of material on the substrate assembly. FIG. 1 schematically illustrates an existing web-format-planarizing machine 10 for planarizing a substrate 12. The planarizing machine 10 has a support table 14 with a top-panel 16 at a workstation where an operative portion (A) of a planarizing pad 40 is positioned. The top-panel 16 is generally a rigid plate to provide a flat, solid surface to which a particular section of the planarizing pad 40 may be secured during planarization.

The planarizing machine 10 also has a plurality of rollers to guide, position and hold the planarizing pad 40 over the top-panel 16. The rollers include a supply roller 20, idler rollers 21, guide rollers 22, and a take-up roller 23. The supply roller 20 carries an unused or pre-operative portion of the planarizing pad 40, and the take-up roller 23 carries a used or post-operative portion of the planarizing pad 40. Additionally, the left idler roller 21 and the upper guide roller 22 stretch the planarizing pad 40 over the top-panel 16 to hold the planarizing pad 40 stationary during operation. A motor (not shown) generally drives the take-up roller 23 to sequentially advance the planarizing pad 40 across the top-panel 16, and the motor can also drive the supply roller 20. Accordingly, clean pre-operative sections of the planarizing pad 40 may be quickly substituted for used sections to provide a consistent surface for planarizing and/or cleaning the substrate 12.

The web-format-planarizing machine 10 also has a carrier assembly 30 that controls and protects the substrate 12 during planarization. The carrier assembly 30 generally has a substrate holder 32 to pick up, hold and release the substrate 12 at appropriate stages of the planarizing process. Several nozzles 33 attached to the substrate holder 32 dispense a planarizing solution 44 onto a planarizing surface 42 of the planarizing pad 40. The carrier assembly 30 also generally has a support gantry 34 carrying a drive assembly 35 that can translate along the gantry 34. The drive assembly 35 generally has an actuator 36, a drive shaft 37 coupled to the actuator 36, and an arm 38 projecting from the drive shaft 37. The arm 38 carries the substrate holder 32 via a terminal shaft 39 such that the drive assembly 35 orbits the substrate holder 32 about an axis B—B (as indicated by arrow $R_1$). The terminal shaft 39 may also rotate the substrate holder 32 about its central axis C—C (as indicated by arrow $R_2$).

The planarizing pad 40 and the planarizing solution 44 define a planarizing medium that mechanically and/or chemically-mechanically removes material from the surface of the substrate 12. The planarizing pad 40 used in the web-format planarizing machine 10 is typically a fixed-abrasive planarizing pad in which abrasive particles are fixedly bonded to a suspension material. In fixed-abrasive applications, the planarizing solution is a "clean solution" without abrasive particles because the abrasive particles are fixedly distributed across the planarizing surface 42 of the planarizing pad 40. In other applications, the planarizing pad 40 may be a non-abrasive pad without abrasive particles that is composed of a polymeric material (e.g., polyurethane) or other suitable materials. The planarizing solutions 44 used with the non-abrasive planarizing pads are typically CMP slurries with abrasive particles and chemicals to remove material from a substrate.

To planarize the substrate 12 with the planarizing machine 10, the carrier assembly 30 presses the substrate 12 against the planarizing surface 42 of the planarizing pad 40 in the presence of the planarizing solution 44. The drive assembly 35 then orbits the substrate holder 32 about the axis B—B, and optionally rotates the substrate holder 32 about the axis C—C, to translate the substrate 12 across the planarizing surface 42. As a result, the abrasive particles and/or the chemicals in the planarizing medium remove material from the surface of the substrate 12.

The CMP processes should consistently and accurately produce a uniformly planar surface on the substrate assembly to enable precise fabrication of circuits and photo-patterns. During the fabrication of transistors, contacts, interconnects and other features, many substrate assemblies develop large "step heights" that create a highly topographic surface across the substrate assembly. Such highly topographical surfaces can impair the accuracy of subsequent photolithographic procedures and other processes that are necessary for forming sub-micron features. For example, it is difficult to accurately focus photo-patterns to within tolerances approaching 0.1 micron on topographic substrate surfaces because sub-micron photolithographic equipment generally has a very limited depth of field. Thus, CMP processes are often used to transform a topographical substrate surface into a highly uniform, planar substrate surface at various stages of manufacturing the microelectronic devices.

One concern of CMP processing is that it is difficult to consistently produce a highly planar surface because the polishing rate and other parameters of CMP processing can vary across the substrate 12 during the planarizing cycle. The polishing rate can vary because properties of the polishing pad and/or the planarizing solution can change during a planarizing cycle. The polishing rate can also vary locally across the substrate surface because of non-uniformities in the (a) distribution of planarizing solution, (b) planarizing surface of the pad, (c) relative velocity between the pad and substrate assembly, and (d) several other dynamic factors that are difficult to monitor or evaluate during a planarizing cycle. The polishing rate even varies because the topography of the wafer changes during the planarizing cycle. Therefore, it would be desirable to be able to monitor and/or control at least some of these dynamic factors during a planarizing cycle.

One proposed technique for monitoring the status of a planarizing cycle is to measure static normal forces between the planarizing pad and the substrate. The normal static forces can be measured by placing an array of piezoelectric sensors laminated within a tiny plastic sheet on the polishing pad, and then pressing the substrate assembly against the plastic sheet. The Tekscan Company currently manufactures a thin plastic piezoelectric array for this purpose. One drawback with the Tekscan device, however, is that the substrate must be disengaged from the polishing pad to place the piezoelectric array in the planarizing zone on the pad. The Tekscan device is thus generally used to take "before" and "after" measurements of a normal force distribution, but not during the planarizing cycle. The static normal forces measured by the Tekscan device when the substrate is stationary may not provide accurate and useful data because the static normal forces can be significantly different than the dynamic normal forces and shear forces exerted when the substrate 12 rubs against the planarizing surface 42 of the planarizing pad 40 during a planarizing cycle. The Tekscan device, therefore, may not provide accurate or useful data for monitoring and controlling a planarizing cycle.

SUMMARY OF THE INVENTION

The present invention is directed toward methods and apparatuses for analyzing and controlling performance parameters in mechanical and chemical-mechanical planarization of microelectronic substrates. In one embodiment, the apparatus is a planarizing machine having a table, a planarizing pad on the table, a carrier assembly having a carrier head configured to hold a microelectronic device substrate assembly, and an array of force sensors embedded in at least one of the planarizing pad, a sub-pad under the planarizing pad, or the table. The force sensor array can include normal and/or shear force sensors. The force sensors can be configured in a grid array, a concentric array, a radial array, or some combination of a grid, concentric, or radial array.

In another embodiment of the invention, the apparatus is a planarizing pad having a body and a plurality of sensors embedded in the body to measure shear and/or normal forces exerted against the planarizing pad by a microelectronic substrate during planarization. The body can have a planarizing surface configured to engage and remove material from the microelectronic substrate, and the plurality of sensors embedded in the body can be configured in an array. The body can also have a plurality of raised portions and a plurality of low regions between the raised portions, and the plurality of force sensors can be embedded in the body at locations relative to the raised portions in order to isolate the shear and/or normal forces exerted against the planarizing pad by the microelectronic substrate during planarization.

In yet another embodiment of the invention, the force sensor array can be embedded in a sub-pad that supports the planarizing pad of a mechanical or chemical-mechanical planarization machine. The sub-pad, for example, can have a body that has a plurality of raised portions and a plurality of low regions between the raised portions. The plurality of force sensors are embedded in the sub-pad body at locations relative to the raised portions in order to isolate the shear and/or normal forces exerted against the sub-pad during planarization of the microelectronic substrate.

One method for analyzing a performance parameter in mechanical and chemical-mechanical planarization of a microelectronic substrate in accordance with an embodiment of the invention includes determining a force distribution exerted against the microelectronic substrate during a planarizing cycle. This embodiment can include removing material from the microelectronic substrate by pressing the substrate against a planarizing surface of a planarizing pad, and sensing a plurality of forces at a plurality of discrete nodes in a planarizing zone of a planarizing machine as the substrate rubs against the planarizing surface. In one aspect of this embodiment, sensing the plurality of forces includes measuring discrete forces using a plurality of force sensors configured in an array in at least one of the planarizing pad, a sub-pad under the planarizing pad, or a support table of a planarizing machine.

One method for analyzing and controlling performance parameters in mechanical and chemical-mechanical planarization of microelectronic substrates in accordance with another embodiment of the invention includes removing material from the microelectronic substrate by pressing the substrate against a planarizing surface, determining a force distribution exerted against the substrate by sensing a plurality of forces at a plurality of discrete nodes as the substrate rubs against the planarizing surface, and controlling a planarizing parameter according to the determined force distribution. Determining the force distribution exerted against the substrate can include measuring a plurality of shear forces that indicate the drag force between the substrate and the planarizing surface, and/or measuring a plurality of normal forces exerted against the substrate that indicate variations in the normal forces between the substrate and the planarizing surface. Controlling the planarizing parameter of the planarizing cycle can include: (a) providing an indication that the substrate is planar based on the determined force distribution, (b) providing an indication that a property of the planarizing solution is within an expected range, (c) providing an indication that the planarizing surface has an acceptable contour based on the determined force distribution, or (d) providing an indication that the planarizing pad has acceptable elasticity based on the determined temporal response. It will be appreciated that in-situ force distributions obtained during the planarizing cycle can also be used to control other planarizing parameters.

DETAILED DESCRIPTION

The present disclosure describes planarization machines with force sensor arrays, methods for determining the forces exerted on a substrate during a planarizing cycle, and methods for controlling the mechanical and/or chemical-mechanical planarization of semiconductor wafers, field emission displays and other types of microelectronic device substrate assemblies using force sensor arrays. The term "substrate assembly" includes both base substrates without microelectronic components and substrates having assemblies of microelectronic components. Many specific details of certain embodiments of the invention are set forth in the following description and in FIGS. 2–9 to provide a thorough understanding of these embodiments. One skilled in the art, however, will understand that the present invention will have additional embodiments, or that the invention may be practiced without several of the details described below.

Figure 1:
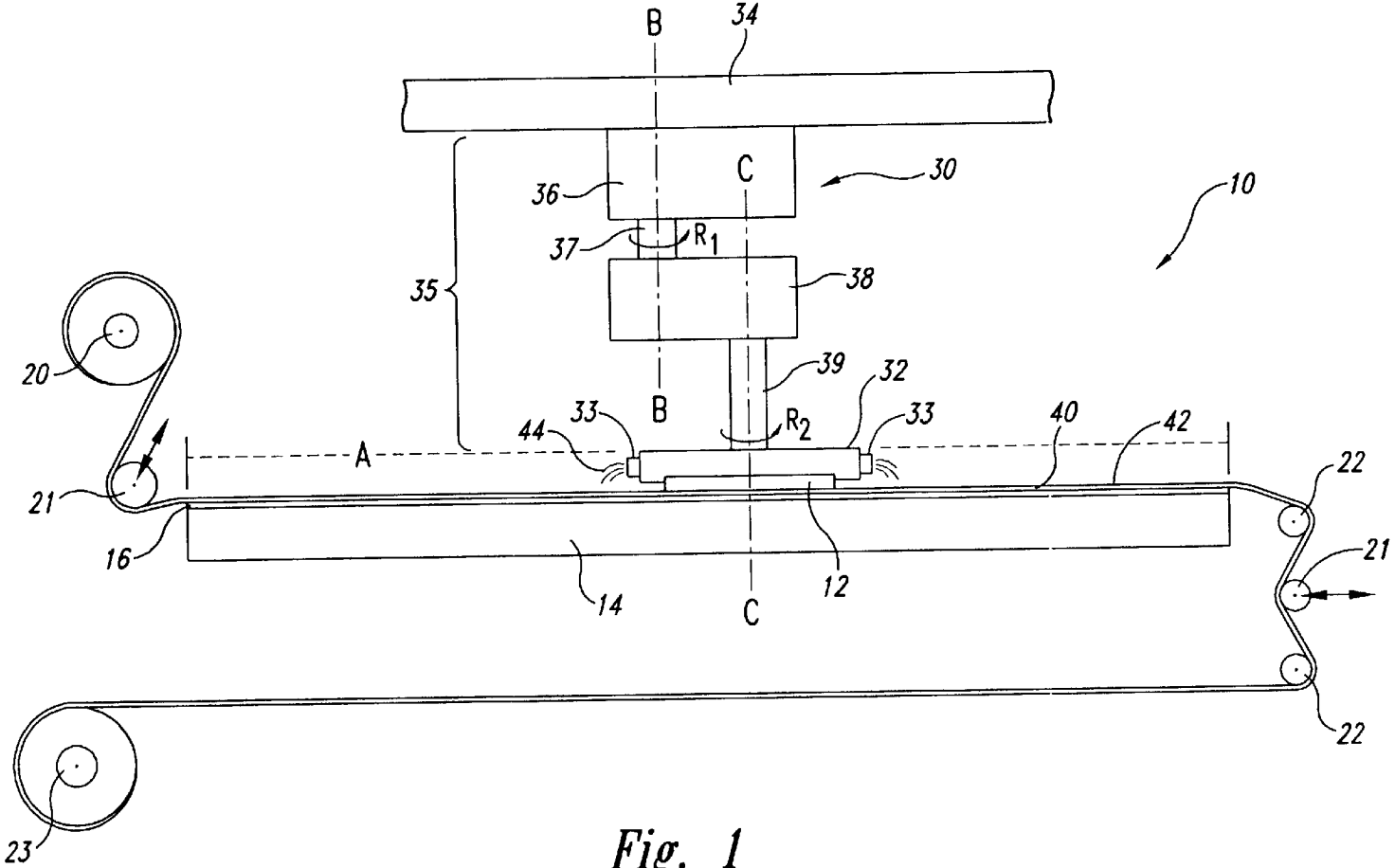
Fig. 1 (Prior Art)
FIG. 1 is a partial schematic side elevational view of a planarizing machine in accordance with the prior art.
Figure 2:
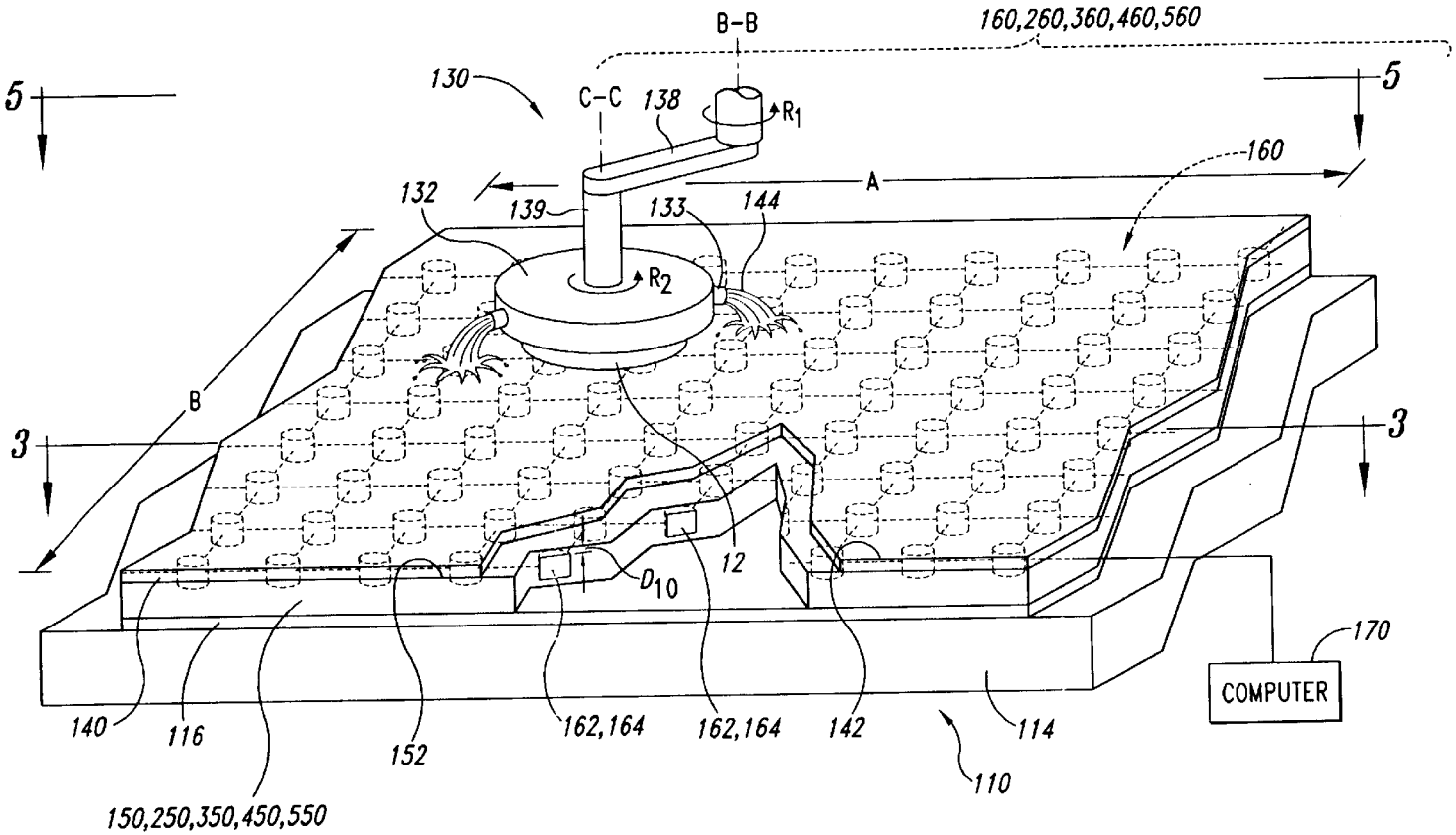
FIG. 2 is partial cut-away isometric view of a planarizing machine including a force sensor array in accordance with an embodiment of the invention.

FIG. 2 is a partial cut-away isometric view of a web-format planarization machine 110 with a force sensor array 160 in accordance with one embodiment of the invention for measuring dynamic normal forces and shear forces between a substrate assembly and a polishing pad during a planarizing cycle. The planarizing machine 110 can have a support table 114, top-panel 116, a planarizing pad 140, and a sub-pad 150. The sub-pad 150 is generally attached to the top-panel 116 at a workstation where an operative portion (A)×(B) of the planarizing pad 140 is positioned. The planarizing machine 110 can also include a carrier assembly 130 having a substrate holder 132. The support table 114, the top-panel 116, and the carrier assembly 130 can be substantially similar to the support table 14, the top panel 16, and the carrier assembly 30 described above with reference to FIG. 1.

The embodiment of the sensor array 160 of FIG. 2 includes a plurality of normal force sensors 162 and/or shear force sensors 164 that are arranged in an X-Y grid. The sensor array 160 of this embodiment is embedded in the sub-pad 150. The force sensors 162 and 164 are connected to a computer 170 to process and/or display the measured force data. The normal force sensors 162 can be piezoelectric force sensors, and the shear force sensors 164 can be strain gauge sensors. In other embodiments, the sensor can be temperature sensors, pressure sensors, or other types of sensors.

In one embodiment of the invention, the sensor array 160 contains both normal force sensors 162 and shear force sensors 164 at preselected positions. In other embodiments, the sensor array 160 contains only normal force sensors 162 or only shear force sensors 164. In one aspect of these embodiments, the sensor array 160 can extend to the boundaries (A)×(B) of the operative portion of the planarizing machine 110 that the substrate holder 132 orbits within during the planarizing cycle. In other embodiments, the sensor array 160 can extend to only a limited part of the operative portion (A)×(B). In another aspect of these embodiments, the force sensors 162 and/or 164 can be positioned a distance $D_{10}$ from a top surface 152 of the sub-pad 150. The distance $D_{10}$ can be approximately 0.010–0.250 inch, and is more preferably 0.040–0.080 inch. In one embodiment, the distance $D_{10}$ is approximately 0.040 inch. In other embodiments, distance $D_{10}$ can have other values, or the force sensors 162 and/or 164 can be positioned flush with the top surface 152 of the sub-pad 150. In addition to the various sensor combinations and positions disclosed, various sensor array patterns are also possible in accordance with the invention.

Figure 3A:
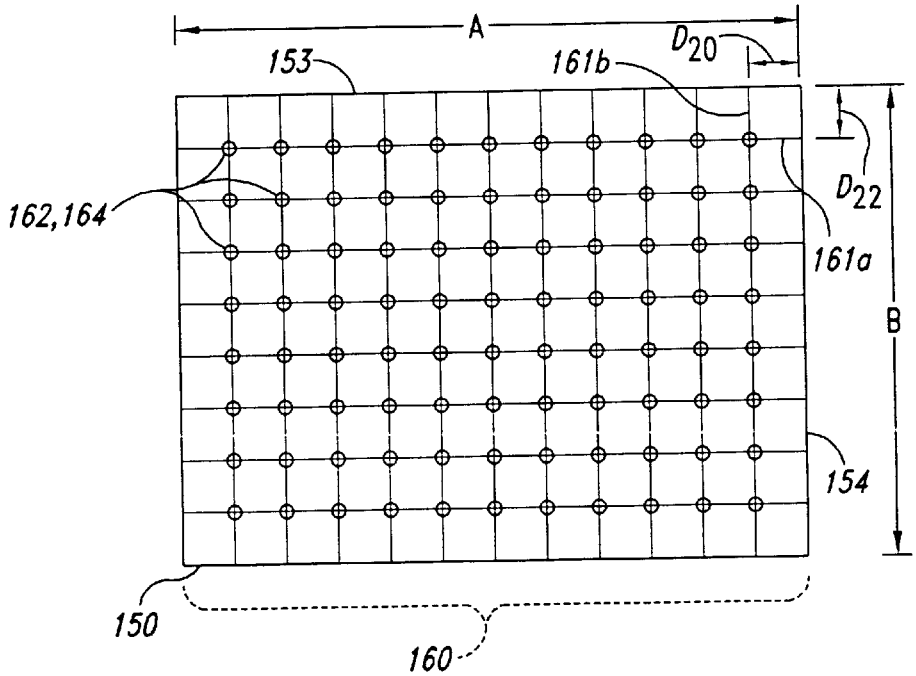
FIGS. 3A–3E are schematic top cross-sectional views illustrating a plurality of force sensor arrays in accordance with various embodiments of the invention.

FIG. 3A is a schematic top cross-sectional view of the grid sensor array 160 embedded in the sub-pad 150 of the web-format-planarizing machine 110 in accordance with the embodiment shown in FIG. 2. As explained above, the grid sensor array 160 can extend over an operative portion (A)×(B) of the sub-pad 150. The plurality of normal force sensors 162 and/or shear force sensors 164 are arranged in rows and columns. In one embodiment, the rows and columns may be spaced apart by equal distances of approximately 0.38 inch. In other embodiments, parallel rows and parallel columns can be spaced apart by other distances that vary across the grid, or by distances that are constant across the grid. A first row of sensors 161*a* can be offset from a first boundary 153 of the operative portion (A)×(B) of the sub-pad 150 by an offset distance $D_{22}$. In one embodiment, the offset distance $D_{22}$ is approximately 0.50 inch, in other embodiments, the offset distance $D_{22}$ can have other values. A first column of sensors 161*b* can be offset from a second boundary 154 of the sub-pad 150 by an offset distance $D_{20}$. In one embodiment, the offset distance $D_{20}$ is approximately 0.50 inch, in other embodiments, the offset distance $D_{20}$ can have other values.

Figure 3B:
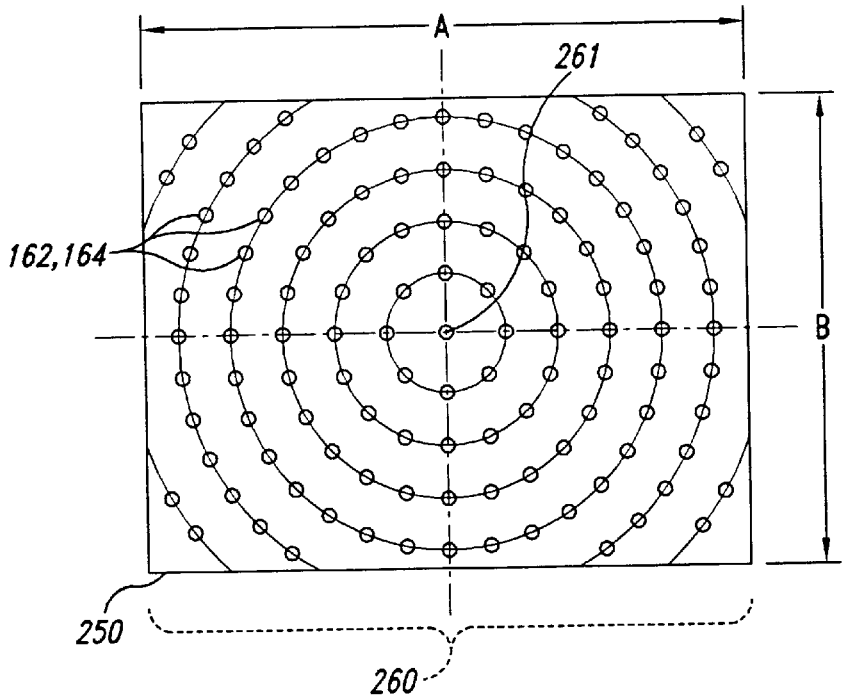

FIG. 3B is a schematic top cross-sectional view of a concentric sensor array 260 embedded in a sub-pad 250 of a web-format-planarizing machine in accordance with another embodiment of the invention. The concentric sensor array 260 can have a plurality of normal force sensors 162 and/or shear force sensors 164 arranged in concentric circles. In one aspect of this embodiment, the concentric circles emanate from the center point 261 of an operative portion (A)×(B) of the sub-pad 250 and are spaced apart from each other by a distance of approximately 0.38 inch in a radial direction. In another aspect of this embodiment, the sensors 162 and/or 164 are spaced apart from each other by a distance of approximately 0.38 inch in a circumferential direction along any given circle of the array. In other embodiments, the concentric array 260 can have other center points, the circles can be spaced apart by other distances, or the sensors can have other spacings along each circle of the array.

Figure 3C:
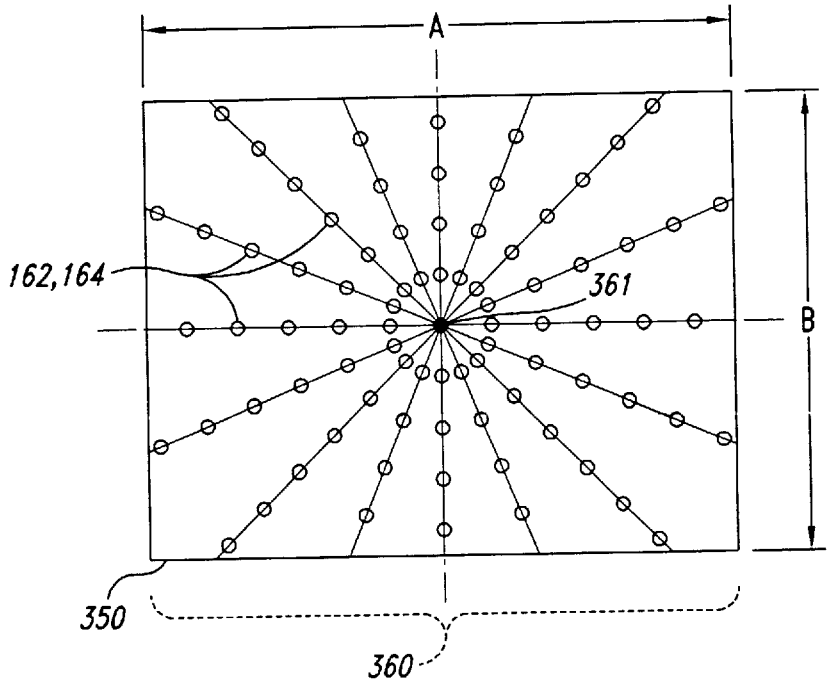

FIG. 3C shows a schematic top cross-sectional view of a radial sensor array 360 embedded in a sub-pad 350 of a web-format-planarizing machine in accordance with yet another embodiment of the invention. The radial sensor array 360 can include a plurality of normal force sensors 162 and/or shear force sensors 164 positioned in rows that pass through a center point 361 of an operative portion (A)×(B) of the sub-pad 350. In one aspect of this embodiment, the rows are spaced apart from each other by equal angles of approximately 5 degrees, and the sensors 162 and/or 164 are spaced apart from each other by equal distances of approximately 0.38 inch along each radial of the array. In other embodiments, the radial array 360 can have other center points, the rows can be spaced apart by other angles, or the sensors can have other spacings along each radial of the array.

Figure 3D:
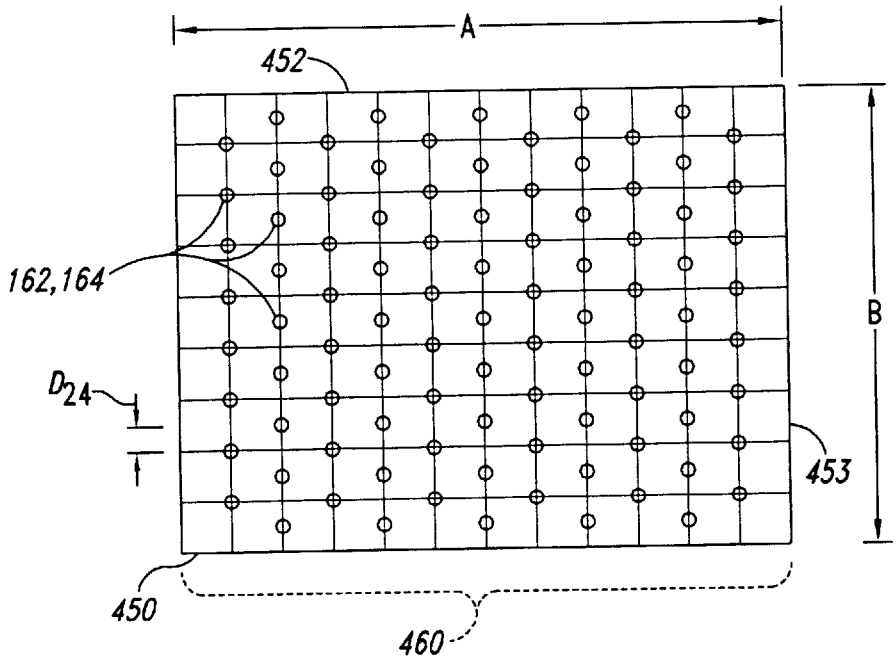

FIG. 3D is a schematic top cross-sectional view of a staggered-grid sensor array 460 embedded in a sub-pad 450 of a web-format-planarizing machine in accordance with still another embodiment of the invention. The staggered-grid sensor array 460 is similar to the grid array 160 shown in FIG. 3A except that the sensors 162, 164 of one column of the staggered grid are offset by a distance $D_{24}$ from the sensors 162, 164 in an adjacent column. In one embodiment, the sensors 162 and/or 164 form columns that are parallel to a first boundary 453 of an operative portion (A)×(B) of the sub-pad 450 and are spaced apart a distance of approximately 0.27 inch. In this embodiment, the distance $D_{24}$ equals approximately 0.27 inch. In other embodiments, the sensor rows can be parallel to a boundary 452, the rows can be spaced apart by other distances, or distance $D_{24}$ can have other values.

Figure 3E:
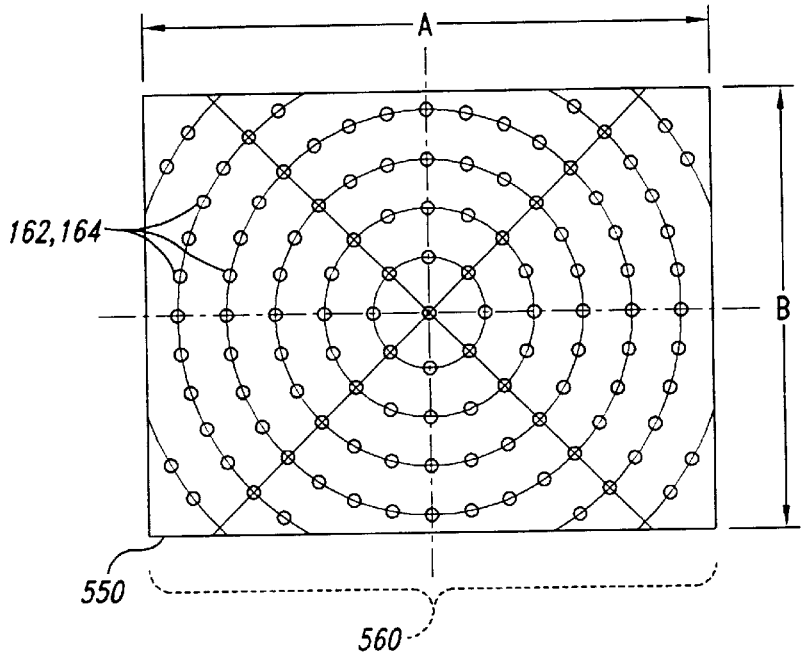

The arrangements of the sensor arrays 160, 260, 360 and 460 can also be combined to provide still more configurations of sensor arrays. For example, FIG. 3E shows a combination sensor array comprised of the concentric sensor array 260 and the radial sensor array 360 of FIGS. 3B and 3C, respectively. Accordingly, numerous other sensor array configurations are possible in addition to the configurations discussed above. Regardless of the configuration of the sensor array, the individual force sensors 162 and/or 164 discussed in accordance with FIGS. 3A–3E measure the normal and/or shear forces exerted on a microelectronic substrate 12 in a substantially similar manner.

Figure 4A:
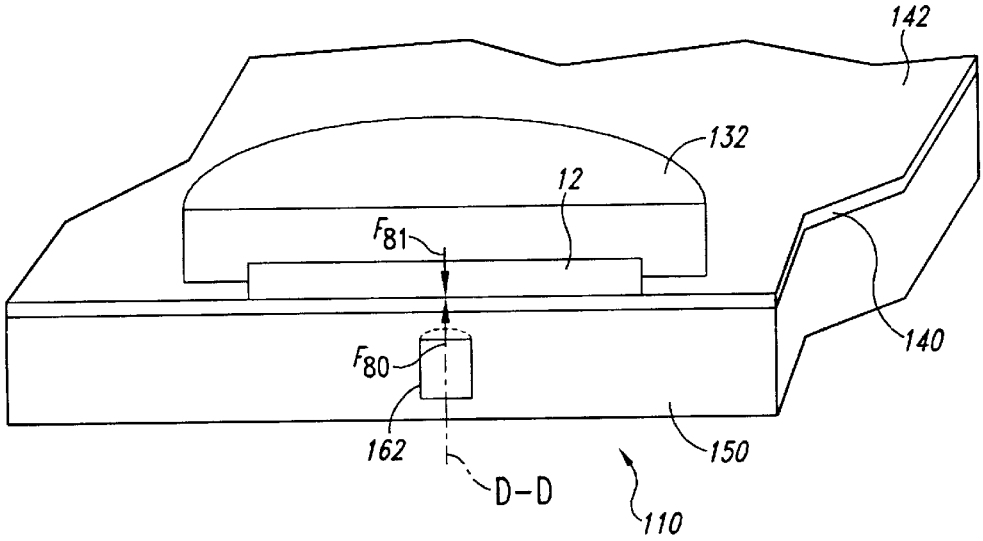
FIGS. 4A and 4B are partial cut-away isometric views of a planarizing apparatus illustrating a normal force and shear force, respectively, acting on a substrate in accordance with two embodiments of the invention.
Figure 4B:
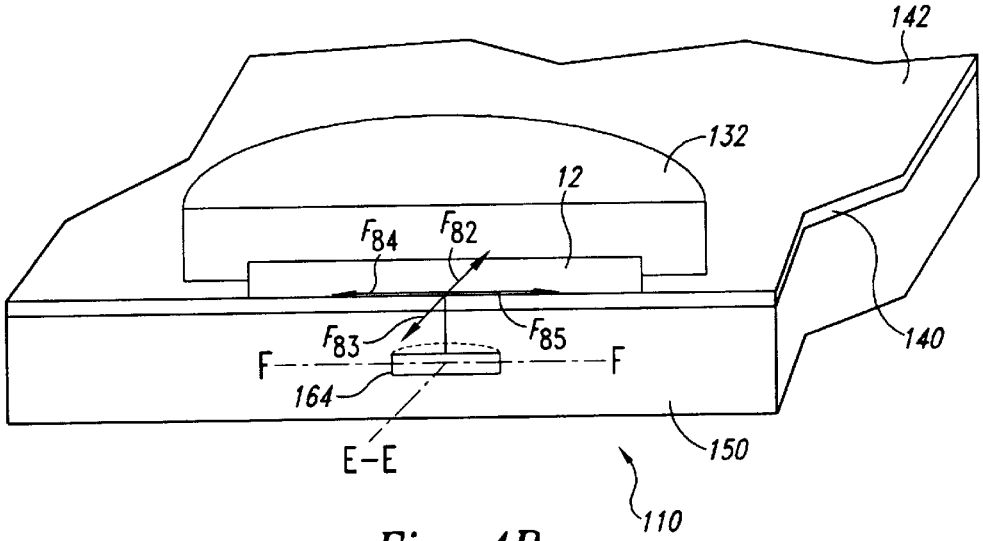

FIG. 4A is a partial cut-away isometric view of the planarizing machine 110 showing the normal force sensor 162 and a normal force $F_{80}$ exerted on the substrate 12 during planarization. The normal force sensor 162 measures forces that are applied along a working axis D-D. FIG. 4B is a partial cut-away isometric view of the planarizing machine 110 showing the shear force sensor 164 and shear forces $F_{83}$ and $F_{85}$ exerted on the substrate 12 during planarization. The shear force sensor 164 measures forces that are applied parallel to working axes E-E and F-F. Referring to FIG. 4A, to measure a normal force $F_{80}$ exerted against the substrate 12 by the planarizing pad 140 (and the reaction normal force $F_{81}$ exerted against the pad 40 by the substrate 12) during the planarizing process, a normal force sensor 162 (such as a piezoelectric force sensor) is embedded in the sub-pad 150 such that the working axis D-D of the normal force sensor 162 is positioned at least substantially normal to a planarizing surface 142 of the planarizing pad 140. Referring to FIG. 4B, to measure shear forces $F_{83}$ and $F_{85}$ exerted against the substrate 12 by the planarizing pad 140 (and the reaction shear forces $F_{82}$ and $F_{84}$ exerted against the pad 140 by the substrate 12) during the planarization process, a shear force sensor 164 (such as a strain gauge sensor) is embedded in the sub-pad 150 such that the working axes E—E and F—F of the shear force sensor define a plane that is at least substantially parallel to the planarizing surface 142 of the planarizing pad 140.

FIGS. 4A and 4B illustrate how an individual sensor can be used to determine a force exerted against a substrate at a discrete node during planarization. When a plurality of force sensors are configured in a desired sensor array and embedded in the sub-pad 150, the sensor array can be used to determine a distribution of forces exerted against the substrate at a plurality of discrete nodes during planarization. As explained in more detail below, the force distribution can be used to monitor and control the planarization process.

Figure 5:
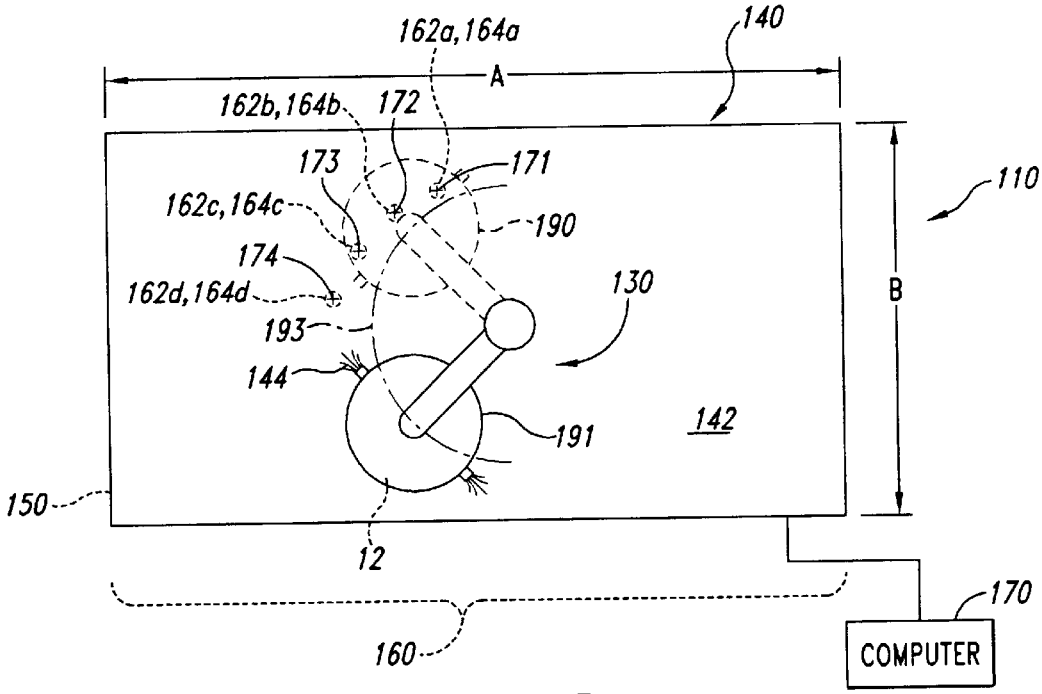
FIG. 5 is a schematic top view of an operative portion of a planarizing apparatus including a force sensor array and illustrating a planarization path of a substrate in accordance with an embodiment of the present invention.

FIG. 5 is a partial schematic top view of the planarizing machine 110 with the sensor array 160 for determining a force distribution exerted on a substrate 12 in the process of being planarized. To planarize the substrate 12, the carrier assembly 130 presses the substrate against the planarizing surface 142 in the presence of a planarizing solution as the substrate 12 orbits across the planarizing surface 142. The abrasive particles and/or the chemicals in the planarizing medium remove material from the surface of the substrate 12 as it moves, for example, from position 190 to position 191 along path 193. The normal forces and shear forces between the substrate 12 and the planarizing pad 140 vary throughout a planarizing cycle because of changes in the topography of the planarizing surface and the substrate surface, the viscosity of the planarizing solution, the distribution of the planarizing solution, and other planarizing parameters.

The sensor array 160 can provide data for determining the normal force distribution between the planarizing pad 140 and the substrate 12 that can be used to control the planarizing process as the substrate moves along path 193 from position 190 to position 191. For example, if the normal force sensors 162*a–c* measure normal forces at their respective nodes 171–173 that deviate from each other or from predetermined levels by more than a predetermined amount, this deviation may be an indication that a planarizing parameter is not within an expected range. For example, a discrepancy in a normal force measurement at a node can indicate that the topography of the substrate 12 is not within an expected range. Similarly, such a deviation in normal force measurements can also indicate that the planarizing surface 142 of the planarizing pad 140 does not have a desired contour, or that a property of the planarizing solution 144 is outside of a desired range. In other aspects of this embodiment, the normal force measurements determined using the normal force sensors 162*a–c* can be used to ascertain other important aspects of the planarizing process, such as the polishing rate and the end-point time. Therefore, the dynamic normal force distribution can be ascertained during a planarizing cycle to provide an indication of the status of the polishing pad 140, the planarizing solution 144, or the substrate 12.

The shear force distribution can be used to monitor other planarizing parameters of the planarizing cycle that cannot be quantified using normal force measurements. For example, the shear force sensors 164*a–c* of the sensor array 160 can provide data for determining the shear force distribution exerted against the substrate as the substrate moves along path 193 from position 190 to position 191. As set forth in U.S. patent application Ser. Nos. 09/386,648, 09/387,309, and 09/386,645, which are herein incorporated by reference, the drag force between the substrate and the planarizing pad 140 can indicate when the substrate becomes planar. As such, if the shear force sensors 164*a–c* measure a shear force distribution that is outside of an expected range, this can indicate that the surface of the substrate 12 is not planarizing in an expected manner. The shear force distribution can also be used to monitor the status of the planarizing solution 144. As set forth in U.S. application Ser. Nos. 09/146,330 and 09/289,791, which are also herein incorporated by reference, the viscosity of the planarizing solution 144 can change according to the topography of the substrate 12, or the viscosity of the planarizing solution 144 can change if unexpected circumstances occur in the size or distribution of the abrasive particles (i.e., agglomerating of particles in a slurry or particles breaking away from a fixed abrasive pad). As such, the shear force distribution exerted on the substrate 12 during the planarization process can also be used to monitor other parameters of the planarizing cycle.

In yet another embodiment of the invention, both a normal force sensor 162 and shear force sensor 164 can be located at each node (i.e., 171–73). The normal and shear force distributions can accordingly be simultaneously determined and used to control several parameters of the planarization process. For example, if the normal force distribution is relatively constant across the substrate surface and the shear force distribution increases in a step-like manner, then such a combined normal force and shear force measurement may indicate that the substrate surface is planar.

In still other embodiments, other useful information for monitoring and controlling the planarization process and the planarizing medium can be obtained in accordance with the present invention. For example, the elasticity of the planarizing pad 140 can be ascertained with the force sensor array 160 by determining the time delay, or temporal response, for the force measurements to return to a non-loaded value. For example, when the substrate 12 is at a position 190 adjacent to normal force sensor 162*a* at node 171, the sensor will measure the normal force between the planarizing pad 140 and the substrate 12 at that node. As the substrate 12 moves away from sensor 162*a* toward position 191 along path 193, the measured force in sensor 162*a* will return to its unloaded value. If the time interval for this force to return to its unloaded value exceeds a predetermined range, this can be an indication that the planarizing pad 140 is no longer within a useful range of elasticity. The elasticity of the planarizing pad 140 can also be ascertained using the shear force sensors 164*a* in a substantially similar manner.

Referring again to FIG. 5, the various methods of controlling the planarization process described above can be automatically implemented by a direct feedback loop between the sensor array 160 and the computer 170. In this embodiment, the computer 170 will receive the force distribution data from the plurality of force sensors and automatically compare this data to a predetermined set of data and/or data from earlier in the planarizing cycle. If the computer 170 determines that the force distribution data is outside of a desired range, then the computer 170 can control the planarizing process by stopping the process, accelerating the process, changing the orbital speed or pressure applied to the substrate 12, changing the flow rate of slurry, or manipulating other parameters of the planarizing process.

The force sensor data can also be used for manual control of the planarization process. In the manual control embodiment, the force sensor data collected from the plurality of force sensors in the sensor array 160 is displayed on a suitable screen of the computer 170 so that an operator of the planarization machine 110 can view the data and ascertain whether the force distribution is within an expected range. If the operator determines that the force distribution data is outside of the expected range, the operator can take appropriate action to control the planarization process in accordance with the methods outlined above.

Another expected advantage of an embodiment of the force sensor array 160 is that the force sensors can determine the force distribution between the planarizing pad 140 and the substrate 12 even when the substrate 12 is not superimposed over the individual force sensors. For example, one of the force sensors 162*d* or 164*d* at a node 174 (FIG. 5) will detect some percentage of the forces exerted on the substrate 12 by the planarizing pad 140 when the substrate is at position 190 even though the substrate 12 is not superimposed over the node 74. This information can be useful in determining whether the motion of the substrate 12 over the planarizing pad 140 is causing the planarizing pad 140 to ripple ahead of the oncoming substrate 12. Such rippling of the planarizing pad could be an indication that the down force or orbital speed is too high and should be modulated accordingly.

Figure 6:
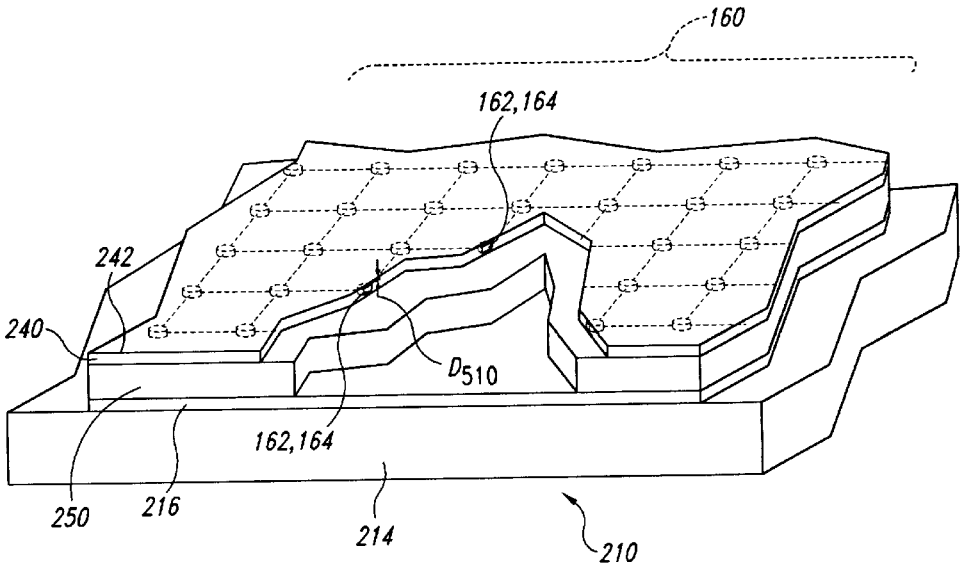
FIG. 6 is a partial cut-away isometric view of a planarizing apparatus including a force sensor array in a planarizing pad in accordance with one embodiment of the invention.

FIG. 6 is a partial cutaway isometric view of a web-format planarization machine 210 including the force sensor array 160 and a planarizing pad 240 in accordance with another embodiment of the invention. The planarizing pad 240 can have a body with a planarizing surface 242 configured to contact a microelectronic substrate for mechanically or chemically-mechanically removing material from the surface of the substrate. The sensor array 160 is embedded in the planarizing pad 240, and the force sensors 162 and 164 of the sensor array 160 are coupled to a computer to process and/or display the measured force data. The force sensors 162 and/or 164 are generally positioned a distance $D_{510}$ from the planarizing surface 242 of the planarizing pad 240. The operation of the planarizing machine 210 can be substantially similar to the planarizing machine 110 explained above with reference to FIGS. 2–5. One expected advantage of embedding the force sensors 162 and 164 in the planarizing pad 240 compared to the sub-pad 150, however, is that a more direct force distribution is measured because the planarizing pad 240 does not distribute or otherwise dampen the forces as it does when the force sensors are embedded in the sub-pad 150.

Figure 7:
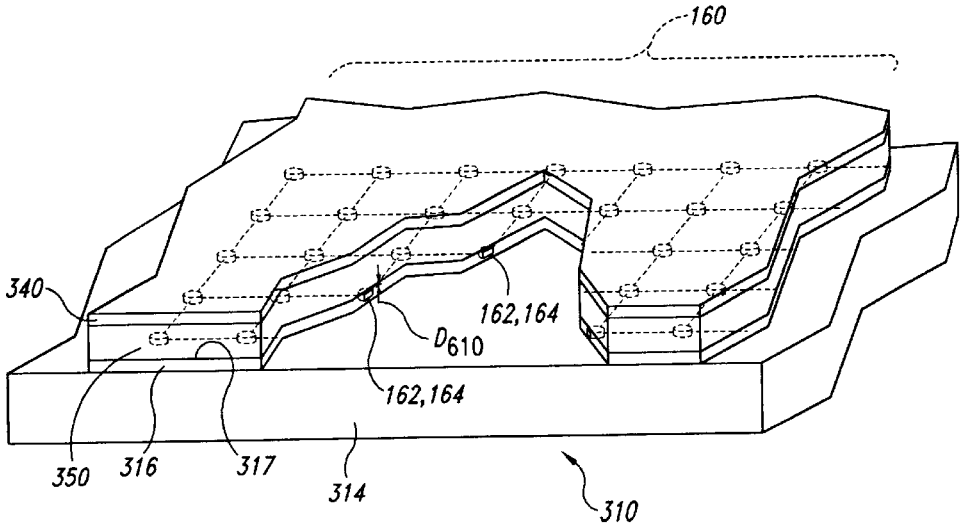
FIG. 7 is a partial cut-away isometric view of a planarizing apparatus including a force sensor array in a top-panel of a table in accordance with one embodiment of the invention.

FIG. 7 is a partial cut-away isometric view of a web-format planarization machine 310 having the force sensor array 160 and a table 314 with a top-panel 316 in accordance with yet another embodiment of the invention. The force sensor array 160 is embedded in the top-panel 316 of the table 314. The force sensors 162 and/or 164 can be positioned a distance $D_{610}$ from the top surface 317 of the top-panel 316, or the force sensors 162 and/or 164 can be positioned flush with a top surface 317 of the top-panel 316. The operation of the planarizing machine 310 is substantially similar to the planarizing machine 110 explained above with reference to FIGS. 2–5. One expected advantage of embedding the force sensors 162 and/or 164 in the top-panel 316 rather than in the planarizing pad 140 or the sub-pad 150, however, is that the force sensor array 160 will not have to be discarded if the planarizing pad 140 or sub-pad 150 have reached their useful life.

Figure 8:
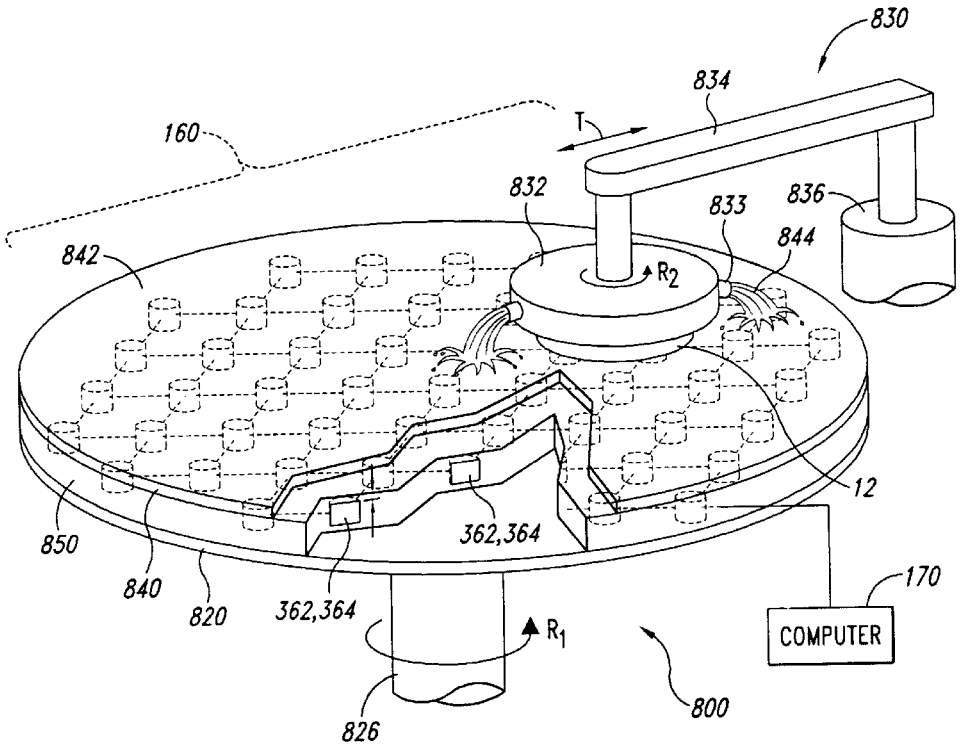
FIG. 8 is a partial cut-away isometric view of a planarizing machine including a force sensor array in accordance with another embodiment of the invention.

FIG. 8 is a cut-away isometric view illustrating a rotary-planarizing machine 800 with the force sensor array 160 embedded in a sub-pad 850 in accordance with another embodiment of the invention. The rotary planarizing machine 800 includes a table 820 attached to a drive assembly 826 that rotates the table 820 (arrow $R_1$) or translates the table 820 horizontally (not shown). The planarizing machine 800 also includes a carrier assembly 830 having a substrate holder 832, an arm 834 carrying the substrate holder 832, and a drive assembly 836 coupled to the arm 834. The substrate holder 832 can include a plurality of nozzles 833 to dispense a planarizing solution 844 onto the planarizing pad 840. In operation, the substrate holder 832 holds a substrate assembly 12 and the drive assembly 836 moves the substrate assembly 12 by rotating (arrow $R_2$) and/or translating (arrow T) the substrate holder 832.

The sensor array 160 embedded in the sub-pad 850 can include the plurality of normal force sensors 162 and/or shear force sensors 164. The sensor array for the rotary planarizing machine 800 can alternatively have a pattern substantially similar to those described above in accordance with FIGS. 3A–3E with reference to the web-format-planarizing machine 110. As such, the sensor array of the rotary planarizing machine 800 can be used to determine a force distribution exerted on the substrate 12 during the planarizing cycle and to control the planarization process in a manner that is substantially similar to that described in accordance with FIGS. 2–5.

The planarizing machine 800 illustrated in FIG. 8 includes other useful embodiments in accordance with the present invention. In one such embodiment, the sensor array 160 can be embedded in the planarizing pad 840 in a manner that is substantially similar to that described in accordance with FIG. 6. In another embodiment, the sensor array 160 can be embedded in the table 820 in a manner substantially similar to that described in accordance with FIG. 7.

Figure 9A:
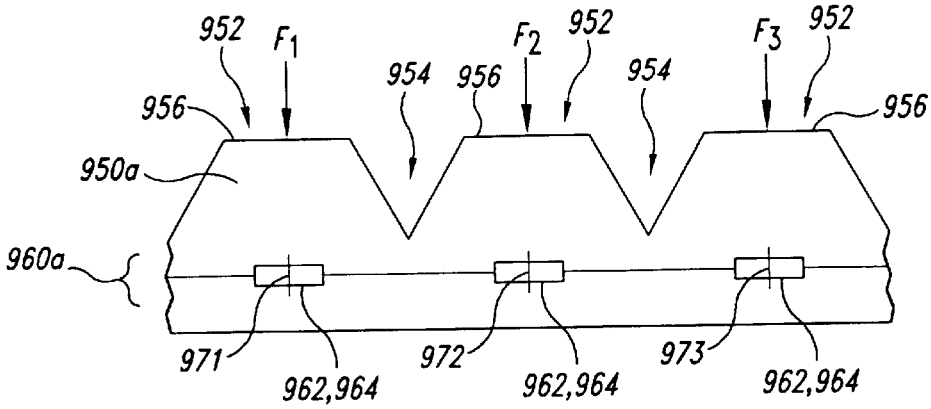
FIGS. 9A–9C are schematic side cross-sectional views of pads for use with a planarizing machine in accordance with three additional embodiments of the invention.

FIG. 9A is a schematic cross-sectional view of a pad 950*a* for use with a planarizing machine to determine the forces exerted against a substrate during the planarizing cycle. The pad 950*a* can be a planarizing pad having a planarizing surface configured to contact the substrate, or the pad 950*a* can be a sub-pad positioned underneath a planarizing pad. The pad 950*a* can have a plurality of raised portions 952 separated by low portions 954, and the pad 950*a* can include a plurality of normal force sensors 952 and/or shear force sensors 964 embedded in the pad 950*a* at nodes 971–973 to form a force sensor array 960*a*. The force sensors 962 and/or 964 are fixedly positioned at least approximately in the center of the raised portions 952 of the pad 950*a*. In one embodiment, the force array 960*a* includes only normal force sensors 962. In another embodiment, the force sensor array 960*a* includes only shear force sensors 964. And in yet another embodiment, the force sensor array 960*a* includes both normal force sensors 962 and shear force sensors 964.

The pad 950*a* is expected to isolate applied forces in a manner that enhances the resolution of the forces at a particular node. When a distributed force is applied to the top surfaces 956 of the pad 950*a*, the low regions 954 will separate the distributed force into discrete forces that can be represented by $F_1$–$F_3$. Consequently, a normal force sensor 962 positioned at node 971 will measure a large percentage of the applied load $F_1$, while another normal force sensor 962 positioned at node 972 will only measure a small percentage of the applied load $F_1$. In contrast, when a distributed force is applied to a pad with a uniform cross-section (as could be represented by the pad 950*a* without the raised portions 952 or low regions 954), there is little separation of the forces, such that a force sensor located at node 972 would measure a significant percentage of a force $F_1$ that was applied to adjacent node 971. Other positions of the sensors 962 and/or 964 in relation to the low regions 954 can be selected to achieve other results in accordance with the present invention.

Figure 9B:
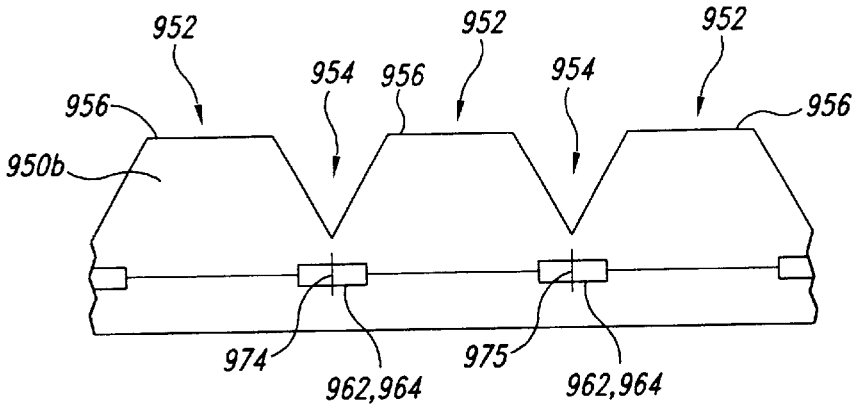

FIG. 9B is a schematic cross-sectional view of a pad 950*b* for use with a planarizing machine to determine the forces exerted against a substrate during the planarizing cycle. The pad 950*b* can be a planarizing pad having a planarizing surface configured to contact the substrate, or the pad 950*b* can be a sub-pad positioned underneath a planarizing pad. The pad 950*b* has a plurality of normal force sensors 962 and/or shear force sensors 964 embedded at nodes 974 and 975 to form a force sensor array. In this embodiment, the force sensors 962 and/or 964 are fixedly positioned at least approximately aligned with the low regions 954.

Figure 9C:
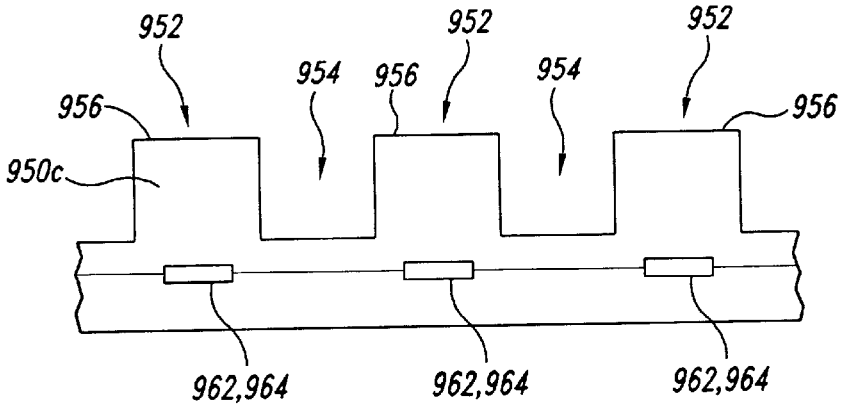

Various alternative configurations of raised portions and low regions are possible in accordance with the present invention. For example, FIG. 9C is a schematic cross-sectional view of a pad 950*c* having raised portions 952*c* and low regions 954*c* that are generally rectangular or cylindrical in shape. Force sensors 962 and/or 964 are fixedly positioned at least approximately in the center of the raised portions 952*c* to form a force sensor array. It is expected that the pad configuration 950*c* illustrated in FIG. 9C will enhance the resolution of the force distribution between a planarizing pad and a substrate in a manner that is substantially similar to that described in accordance with the pad 950*a* shown in FIG. 9A. Those skilled in the art will appreciate, that various other pad configurations are possible for isolating forces by selectively positioning the force sensors in relation to raised portions and/or low regions of the pad.

From the foregoing, it will be appreciated that even though specific embodiments of the invention have been described herein for purposes of illustration, various modifications can be made without deviating from the spirit and scope of the invention. Accordingly, the invention is not limited except as by the appended claims.

What is claimed is:

1. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface; and sensing a plurality of shear forces at a plurality of discrete nodes in a planarizing zone of the planarizing machine as the substrate rubs against the planarizing surface.

2. The method of claim 1 wherein sensing a plurality of shear forces comprises measuring discrete forces using a plurality of individual sensors configured in an array in at least one of the planarizing pad, a sub-pad under the planarizing pad, or a support table of the planarizing machine that supports the planarizing pad.

3. The method of claim 1 wherein sensing a plurality of shear forces comprises measuring discrete forces using a plurality of individual sensors configured in a grid array in at least one of the planarizing pad, a sub-pad under the planarizing pad, or a support table of the planarizing machine that supports the planarizing pad.

4. The method of claim 1 wherein the plurality of shear forces comprises a plurality of shear forces exerted between the substrate and the planarizing pad.

5. The method of claim 1, further comprising controlling a planarizing parameter of the planarizing machine according to a distribution of the sensed forces.

6. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface; and sensing a plurality of shear forces exerted against the pad by the substrate at a plurality of discrete nodes in a planarizing zone of the planarizing machine as the substrate rubs against the planarizing surface.

7. The method of claim 6 wherein sensing a plurality of shear forces comprises measuring discrete forces using a plurality of individual sensors configured in an array in at least one of the planarizing pad, a sub-pad under the planarizing pad, or a support table of the planarizing machine that supports the planarizing pad.

8. The method of claim 6 wherein sensing a plurality of shear forces comprises measuring discrete forces using a plurality of individual sensors configured in a grid array in at least one of the planarizing pad, a sub-pad under the planarizing pad, or a support table of the planarizing machine that supports the planarizing pad.

9. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface;

determining a force distribution exerted against the substrate by sensing a plurality of shear forces at a plurality of discrete nodes in a planarizing zone of the planarizing machine as the substrate rubs against the planarizing surface; and controlling a planarizing parameter of a planarizing cycle according to the determined force distribution.

10. The method of claim 9 wherein:

determining the force distribution exerted against the substrate comprises measuring a plurality of shear forces exerted against the planarizing pad by the substrate to determine a shear force distribution that is indicative of drag force between the substrate and the planarizing surface; and controlling the planarizing parameter of the planarizing cycle comprises providing an indication that the substrate is planar based on the determined force distribution.

11. The method of claim 10 wherein controlling the planarizing parameter further comprises providing an indication that the substrate is planar based on a step increase in the determined shear force distribution.

12. The method of claim 9 wherein:

determining the force distribution exerted against the substrate comprises measuring a plurality of shear forces exerted against the planarizing pad by the substrate to determine a shear force distribution that is indicative of drag force between the substrate and the planarizing surface; and controlling the planarizing parameter of the planarizing cycle comprises providing an indication that the substrate is not planar based on the determined force distribution.

13. The method of claim 12 wherein controlling the planarizing parameter further comprises providing an indication that the substrate is not planar based on the absence of a step increase in the determined shear force distribution.

14. The method of claim 9 wherein:

determining the force distribution exerted against the substrate comprises measuring a plurality of shear forces exerted against the planarizing pad by the substrate to determine a shear force distribution that is indicative of drag force between the substrate and the planarizing surface; and controlling the planarizing parameter of the planarizing cycle comprises providing an indication that a property of a planarizing solution is within an expected range based on the determined force distribution.

15. The method of claim 14 wherein controlling the planarizing parameter comprises providing an indication that viscosity of the planarizing solution is within an expected range.

16. The method of claim 9 wherein:

determining the force distribution exerted against the substrate comprises measuring a plurality of shear forces exerted against the planarizing pad by the substrate to determine a shear force distribution that is indicative of drag force between the substrate and the planarizing surface; and controlling the planarizing parameter of the planarizing cycle comprises providing an indication that the planarizing surface has an acceptable contour based on the determined force distribution.

17. The method of claim 9 wherein:

determining the force distribution exerted against the substrate further comprises measuring a plurality of normal forces exerted against the planarizing pad by the substrate to determine a normal force distribution that is indicative of a variation in normal force between the substrate and the planarizing surface; and controlling the planarizing parameter of the planarizing cycle comprises providing an indication that the substrate is planar based on the determined force distribution.

18. The method of claim 9 wherein:

determining the force distribution exerted against the substrate further comprises measuring a plurality of normal forces exerted against the planarizing pad by the substrate to determine a normal force distribution that is indicative of a variation in normal force between the substrate and planarizing surface; and controlling the planarizing parameter of the planarizing cycle comprises providing an indication that a property of a planarizing solution is within an expected range based on the determined force distribution.

19. The method of claim 9 wherein:

determining the force distribution exerted against the substrate further comprises measuring a plurality of normal forces exerted against the planarizing pad by the substrate to determine a normal force distribution that is indicative of a variation in normal force between the substrate and planarizing surface; and controlling the planarizing parameter of the planarizing cycle comprises providing an indication that the planarizing surface has an acceptable contour based on the determined force distribution.

20. The method of claim 9 wherein:

determining the force distribution exerted against the substrate further comprises determining a temporal response that is indicative of elastic properties of the planarizing pad; and controlling the planarizing parameter of the planarizing cycle comprises providing an indication that the planarizing pad has acceptable elasticity based on the determined temporal response.

21. The method of claim 9 wherein:

determining the force distribution exerted against the substrate further comprises determining a temporal response that is indicative of elastic properties of a sub-pad under the planarizing pad; and controlling the planarizing parameter of the planarizing cycle comprises providing an indication that the sub-pad has acceptable elasticity based on the determined temporal response.

22. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface;

determining a force distribution exerted against the substrate by sensing a plurality of shear forces exerted against the substrate by the planarizing pad at a plurality of discrete nodes in a planarizing zone of the planarizing machine as the substrate rubs against the planarizing surface; and controlling a planarizing parameter of the planarizing cycle according to the determined force distribution.

23. The method of claim 22 wherein:

determining the force distribution exerted against the substrate comprises measuring a plurality of shear forces exerted against the planarizing pad by the substrate to determine a shear force distribution that is indicative of drag force between the substrate and the planarizing surface, and measuring a plurality of normal forces exerted against the planarizing pad by the substrate to determine a normal force distribution that is indicative of a variation in normal force between the substrate and the planarizing surface; and controlling a planarizing parameter comprises providing an indication that the substrate is planar based on a step increase in the determined shear force distribution that occurs while the determined normal force distribution remains substantially unchanged.

24. A method for determining a force exerted against a microelectronic substrate during a planarizing cycle, comprising:

removing material from the microelectronic substrate by pressing the substrate against a planarizing surface of a planarizing pad and imparting motion to the substrate and/or the planarizing pad to rub the substrate against the planarizing surface;

isolating forces exerted against the planarizing surface at discrete nodes in a planarizing zone of the planarizing surface; and sensing a shear force at a first discrete node.

25. The method of claim 24 wherein sensing a shear force comprises measuring a discrete force using a sensor in at least one of the planarizing pad, a sub-pad under the planarizing pad, or a support table of the planarizing machine that supports the planarizing pad.

26. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface;

determining a shear force distribution exerted against the substrate by the planarizing surface of the planarizing pad by sensing a plurality of forces at a plurality of discrete nodes in a planarizing zone of the planarizing machine as the substrate rubs against the planarizing surface;

comparing the determined force distribution to an expected force distribution; and controlling a planarizing parameter of a planarizing cycle according to the determined force distribution.

27. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface;

determining a shear force distribution that is indicative of drag force between the substrate and the planarizing surface by sensing a plurality of shear forces exerted against the planarizing pad by the substrate at a plurality of discrete nodes in a planarizing zone of the planarizing machine as the substrate rubs against the planarizing surface; and controlling a planarizing parameter of a planarizing cycle according to the determined force distribution.

28. The method of claim 27 wherein controlling the planarizing parameter of the planarizing cycle comprises providing an indication that the substrate is planar based on the determined shear force distribution.

29. The method of claim 28 wherein controlling the planarizing parameter further comprises providing an indication that the substrate is planar based on a step increase in the determined shear force distribution.

30. The method of claim 27 wherein controlling the planarizing parameter of the planarizing cycle comprises providing an indication that the substrate is not planar based on the determined shear force distribution.

31. The method of claim 30 wherein controlling the planarizing parameter further comprises providing an indication that the substrate is not planar based on the absence of a step increase in the determined shear force distribution.

32. The method of claim 27 wherein controlling the planarizing parameter of the planarizing cycle comprises providing an indication that a property of a planarizing solution is within an expected range based on the determined force distribution.

33. The method of claim 32 wherein controlling the planarizing parameter comprises providing an indication that a viscosity of the planarizing solution is within an expected range.

34. The method of claim 27 wherein controlling the planarizing parameter of the planarizing cycle comprises providing an indication that the planarizing surface has an acceptable contour based on the determined force distribution.

35. A method for planarizing a microelectronic substrate, comprising:

removing material from the microelectronic substrate by pressing the substrate against a planarizing surface of a planarizing pad carried by a planarizing machine and imparting motion to the substrate and/or the planarizing pad to rub the substrate against the planarizing surface;

determining a shear force distribution that is indicative of drag force between the substrate and the planarizing surface by sensing a plurality of shear forces exerted against the planarizing pad by the substrate at a plurality of discrete nodes in a planarizing zone of the planarizing machine as the substrate rubs against the planarizing surface;

determining a normal force distribution that is indicative of variation in normal force between the substrate and the planarizing surface by sensing a plurality of normal forces exerted against the planarizing pad by the substrate as the substrate rubs against the planarizing surface; and providing an indication that the substrate is planar in response to determining a step increase in the shear force distribution that occurs while the determined normal force distribution remains substantially unchanged.

* * * * *

UNITED STATES PATENT AND TRADEMARK OFFICE

CERTIFICATE OF CORRECTION

PATENT NO. : 6,520,834 B1 
DATED : February 18, 2003
INVENTOR(S) : Brian Marshall It is certified that error appears in the above-identified patent and that said Letters Patent is hereby corrected as shown below:

Column 2,
Line 67, "tiny" should be -- thin --;

Signed and Sealed this

Twelfth Day of August, 2003

JAMES E. ROGAN
*Director of the United States Patent and Trademark Office*